US007044418B2

(12) United States Patent
Leisten

(10) Patent No.: US 7,044,418 B2
(45) Date of Patent: May 16, 2006

(54) STRIP WINDING AND UNWINDING DEVICE WITH AUTOMATIC CENTERING

(75) Inventor: Winfried Leisten, Hilchenbach (DE)

(73) Assignee: SMS Demag AG, Düsseldorf (DE)

( * ) Notice: Subject to any disclaimer, the term of this patent is extended or adjusted under 35 U.S.C. 154(b) by 157 days.

(21) Appl. No.: 10/487,685

(22) PCT Filed: Aug. 16, 2002

(86) PCT No.: PCT/EP02/09193

§ 371 (c)(1),
(2), (4) Date: Feb. 24, 2004

(87) PCT Pub. No.: WO03/022477

PCT Pub. Date: Mar. 20, 2003

(65) Prior Publication Data

US 2004/0232272 A1 Nov. 25, 2004

(30) Foreign Application Priority Data

Aug. 24, 2001 (DE) ..... 101 41 567

(51) Int. Cl.
*B65H 18/08* (2006.01)

(52) U.S. Cl. ..... 242/539; 242/575.3; 384/559

(58) Field of Classification Search ..... 242/539, 242/597.8, 598.5, 599.3, 575.3; 384/559, 384/585

See application file for complete search history.

(56) References Cited

U.S. PATENT DOCUMENTS 3,527,425 A 9/1970 Shumaker

FOREIGN PATENT DOCUMENTS

| | | |
|---|---|---|
| DE | 543201 | 2/1932 |
| DE | 195 37 778 A1 | 4/1997 |
| FR | 1321849 | 5/1962 |
| WO | 0164364 | 9/2001 |

OTHER PUBLICATIONS

Patent Abstracts of Japan, vol. 2000, No. 06, Sep. 22, 2000 & JP 2000 074051 A (Hitachi LTD), Mar. 7, 2000.

*Primary Examiner*—John Q. Nguyen
(74) *Attorney, Agent, or Firm*—Friedrich Kueffner

(57) ABSTRACT

The invention concerns a device for winding/unwinding metal strips, in particular for steel bands, comprising a mandrel (4) mounted mobile in rotation in a bearing (4*a*), and serves to provide means for pivoting, seizing, centering and suppoting the mandrel (4) of the winding/unwinding device. Therefor, the invention is characterized in that the bearing of the mandrel (4) is enclosed, on the outer ring (6) of the bearing, in an annular slot (7), and said outer ring (6) can be centered by means of a fixing element (8) capable of being closed inwards when the mandrel (4) is inserted, or can be freely mobile inside said annular slot (7) when the fixing elements (8) are returned outwards.

13 Claims, 5 Drawing Sheets

STRIP WINDING AND UNWINDING DEVICE WITH AUTOMATIC CENTERING

The invention concerns a coiler for metal strip, especially steel strip, with a coiler mandrel pivoted in coiler bearings.

The previously known outer supports for coilers in the form of swinging gates cannot reliably and reproducibly center the tip of the coiler mandrel, because the tip of the coiler mandrel can change its position relative to the theoretical axis of the coiler mandrel. Unfavorable lever ratios and the principle of cones (as parts of self-aligning roller bearings) which roll over each other often do not allow the conventional outer supports of coilers to swing fully; and as a result the tip of the coiler mandrel can not be securely gripped, and the rotating coiler mandrel wobbles. This leads to engineering and technological problems during rolling. Both the load on the coiler mandrel (coil weight, strip tension) and the wear of, or damage to, the coiler mandrel and its bearing can cause the tip of the coiler mandrel to depart from its theoretical position relative to the axis of the coiler mandrel.

U.S. Pat. No. 3,527,425 A describes a coiler mandrel bearing without a swinging gate. The roller bearing is held rigidly in a bearing block by its outer ring. To release the entire bearing block from its bracing against a stationary stop, which lies on the opposite side, a wedge is provided, which rises obliquely from bottom to top towards the bearing block and can be moved back and forth by a piston-cylinder assembly. After retraction of the wedge by this piston-cylinder assembly, a linear actuator, which is located on the opposite side of the bearing from the wedge, pushes the coiler mandrel from the eye of the wound coil. However, this does not allow the coiler mandrel to be reliably pivoted, gripped, centered, and supported.

JP 2000-074051 likewise fails to provide for a swinging gate for the coiler mandrel bearing, but rather involves a double-row conical antifriction bearing (roller bearing), whose first outer ring is rigidly held in the bearing housing, and whose second outer ring is mounted with clearance. The second outer ring with clearance can be acted on in the axial direction by one or more setscrews. However, this adjusts this outer ring only with respect to the row of tapered rollers in question for the purpose of affecting the clearance.

The objective of the invention is to propose measures that ensure reliable swinging of the swinging gate and gripping, centering, and support of the coiler mandrel.

Therefore, the invention is characterized by the fact that the coiler mandrel bearing is surrounded by an annular gap at the outer ring of the pivot bearing, and that the pivot bearing outer ring can be centered by means of clamping devices that can be closed inwardly when the mandrel is inserted or can be freely moved inside the annular gap when the clamping devices are moved back outwardly. In this way, the tip of the coiler mandrel can be reliably pivoted into the coiler bearing, centered, and supported for the operation. The tip of the coiler mandrel is not clamped; it can move axially. The method of bearing on the tip of the coiler mandrel must take into account the bending of the coiler mandrel.

A refinement provides that the annular gap accommodates a deviation of at least 10 mm in the position of the coiler mandrel. This gives the outer ring of the swivel bearing sufficient freedom to move as the coiler mandrel is fed into it.

The design provides that a support ring formed on and attached to the support frame holds an inner ring, which is guided with freedom of rotation, and in which the clamping elements, which are actuated by rotation, are installed.

So that the force which rotates the inner ring can be transmitted effectively, the inner ring is designed so that it can be rotated and thus adjusted by a piston-cylinder drive, which is installed outside the support ring and exerts a lever action with a hinge point a certain distance away from the theoretical center of the coiler mandrel.

Other refinements are characterized in that the piston-cylinder drive can be moved between an open position, in which the hinge point of the piston rod lies in the horizontal plane in which the theoretical center of the coiler mandrel also lies, to a closed position below the horizontal plane containing the theoretical center of the coiler mandrel, where the housing of the piston-cylinder drive is mounted on the support frame by way of a hinge-type joint. This makes it possible for the pivoting movement to include a lateral component.

In a refinement of the invention, it is proposed that the inner ring be provided with control surfaces distributed around the circumference, each approximately tangential to the outer ring swivel bearing for the coiler mandrel to be centered, against which control surfaces the clamping elements make sliding contact. This has the advantage that the clamping force can be transmitted without play.

The clamping elements are guided positively during both the closing and the opening operations. The beginning and end positions are thus reached with great accuracy.

Another refinement is characterized in that each clamping element consists of a clamping block, which can slide along the associated control surface.

It is also advantageous for a mechanical stop face to be formed between the inner ring and the slide block.

An additional advantage derives from the fact that a section of each control surface consists of a slide piece, which is attached to the support ring. This creates a sliding surface for the clamping block, and this sliding surface can be replaced in the event of wear.

In addition, it is advantageous for the surface of the clamping block facing the center to conform to the curvature of the outer ring of the swivel bearing. As a result, supporting forces can be transmitted effectively to the outer ring of the roller bearing.

An advantageous method by which the slide piece can be advantageously brought into its actual working position is by supporting each clamping block on a pivot axis mounted in brackets on both sides, the axis passing through the clamping block and ending-on the outside at the rigidly mounted support ring. The brackets force the clamping blocks to return to their original distance from the axis of the coiler mandrel in correspondence with the position of the inner ring, and they also completely prevent the upper clamping block from dropping out.

Another modification provides that the support ring in the support frame is designed as an interchangeable cartridge. Spare cartridges can be kept on hand, and fabrication is greatly simplified.

The drawings illustrate an exemplary embodiment of the invention, which is explained in greater detail below.

Figure 1:
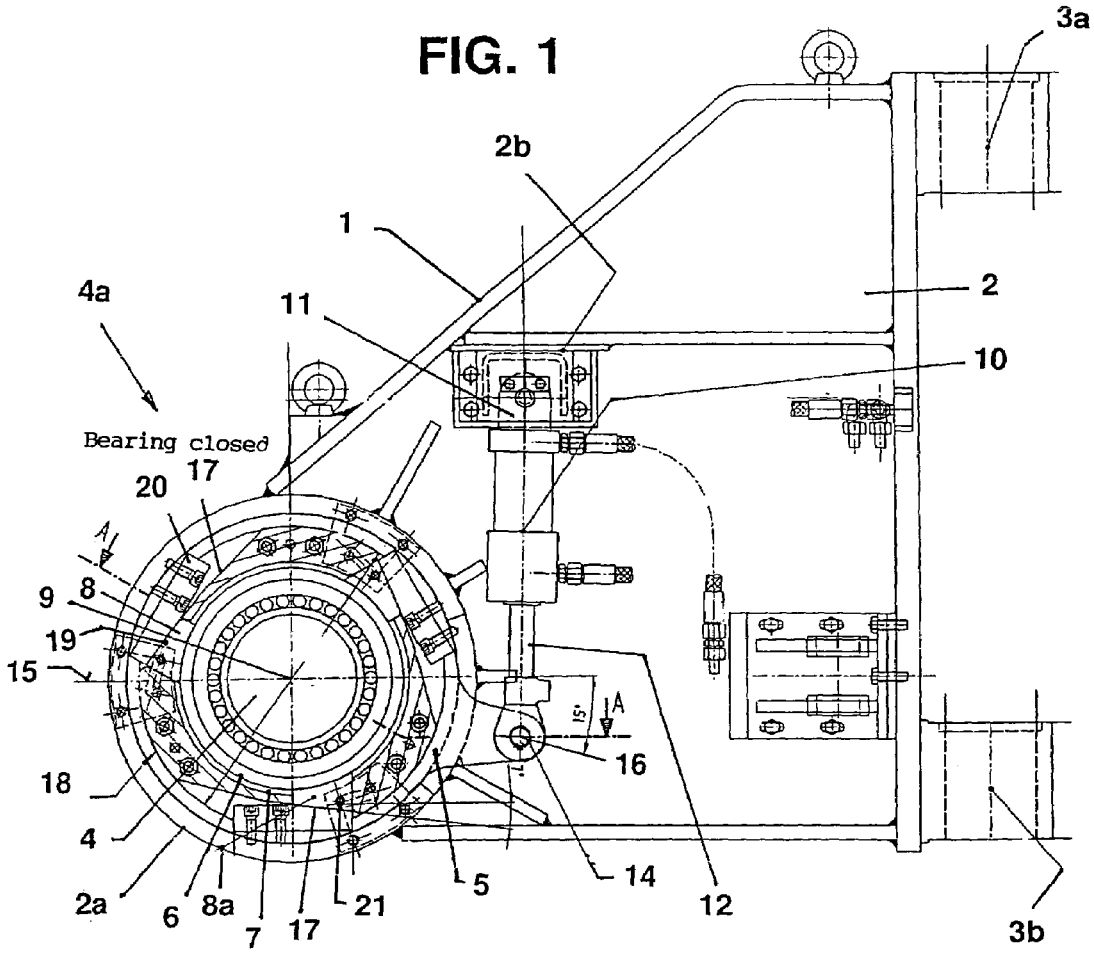
FIG. 1 shows a front view of a swinging gate with a coiler mandrel bearing.

The swinging gate 1 is provided for a coiler for metal strip, especially steel strip, which is coiled on the coiler mandrel 4. A support frame 2 consists of a welded structure comprising, for example, strips and ribs 2*b*. This welded structure includes a support ring 2*a*, which holds the coiler mandrel bearing 4*a*.

The swinging gate 1 can swing around swivel bearings 3*a*, 3*b*, but the coiler mandrel 4 can deviate from the theoretical center 9 of the mandrel. As a result, it can be difficult or impossible to feed the tip of the coiler mandrel into the coiler mandrel bearing 4*a*.

Providing the coiler mandrel bearing 4 with an annular gap 7 surrounding the outer ring 6 of the swivel bearing makes it possible to feed the tip of the coiler mandrel into the bearing. After the clamping elements 8 have been moved back towards the outside, the swivel bearing outer ring 6 can move freely inside the annular gap 7 until the coiler mandrel 4 has found the coiler mandrel bearing 4*a*. After the coiler mandrel 4 has been inserted, the outer ring 6 of the bearing is centered and supported by means of the clamping elements 8, which can be moved inward until they lock against the ring. During this process, the annular gap 7 can shift its position by at least 10 mm to accommodate the positional deviation of the coiler mandrel 4.

Various designs of the clamping element 8 are possible. One advantageous embodiment (FIG. 1) provides a support ring 2*a*, which forms part of the bearing support 2. This ring is rigidly connected to the welded structure and holds a rotatable inner ring 5. The clamping elements 8, which can be actuated by rotation, are supported on the inner ring 5. A lever, which is attached to the inner ring 5, extends radially outward through an opening in the support ring 2*a*. A piston-cylinder drive 10 is mounted outside the support ring 2*a* and exerts a levering action by way of a hinge point a certain distance away from the theoretical center 9 of the coiler mandrel. The piston rod 12 is attached to the inner ring 5, and the inner ring 5 provides parallel guides 25 for the clamping blocks 8*a*. In the open position 13 shown in FIG. 3, the hinge point 14 lies in the same horizontal plane 15 as that which contains the theoretical center 9 of the coiler mandrel. The piston-cylinder drive 10 moves the inner ring 5 with the clamping elements 8 into the closed position 16, shown in FIG. 4. The closed position 16 is defined by the mechanical stop face 20*a* between the inner ring 5 and the sliding block 20. The hinge point 14 thus arrives in a position about 15° below the horizontal plane 15 in which the theoretical center 9 of the coiler mandrel lies. So that the piston-cylinder drive 10 can follow along with this movement, its housing 11 is supported on the support frame 2 by means of a hinge-type joint attached to one of the ribs 2*b*.

The piston rod 12 is connected at the hinge point by means of the forked end shown in the drawing.

The inner ring 5 functions as follows:

The inner ring 5 is provided with, for example, three control surfaces 17, spaced 1200 apart, each surface being more-or-less tangential to the outer ring 6 of the swivel bearing for the coiler mandrel 4 to be centered. The clamping elements 8 are in sliding contact with these control surfaces 17. In the embodiment shown here, the clamping elements 8 are guided positively during both the closing and the opening of the coiler mandrel bearing 4*a*.

Figure 2:
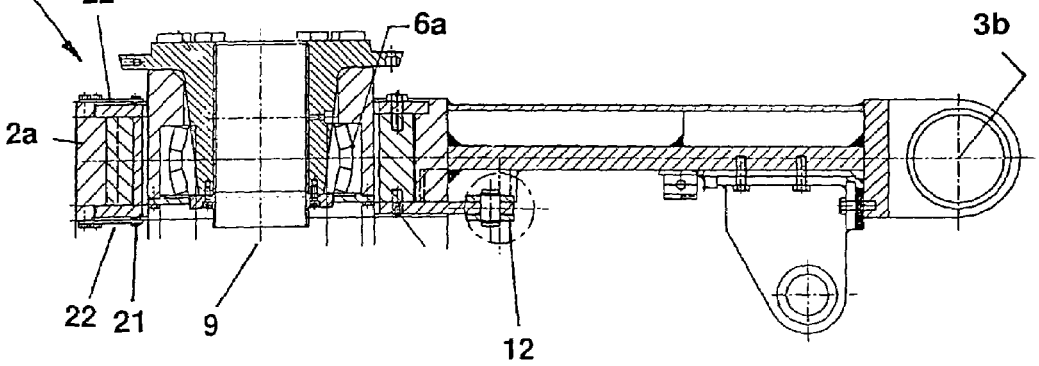
FIG. 2 shows a cross section along line A—A in FIG. 1.
Figure 3:
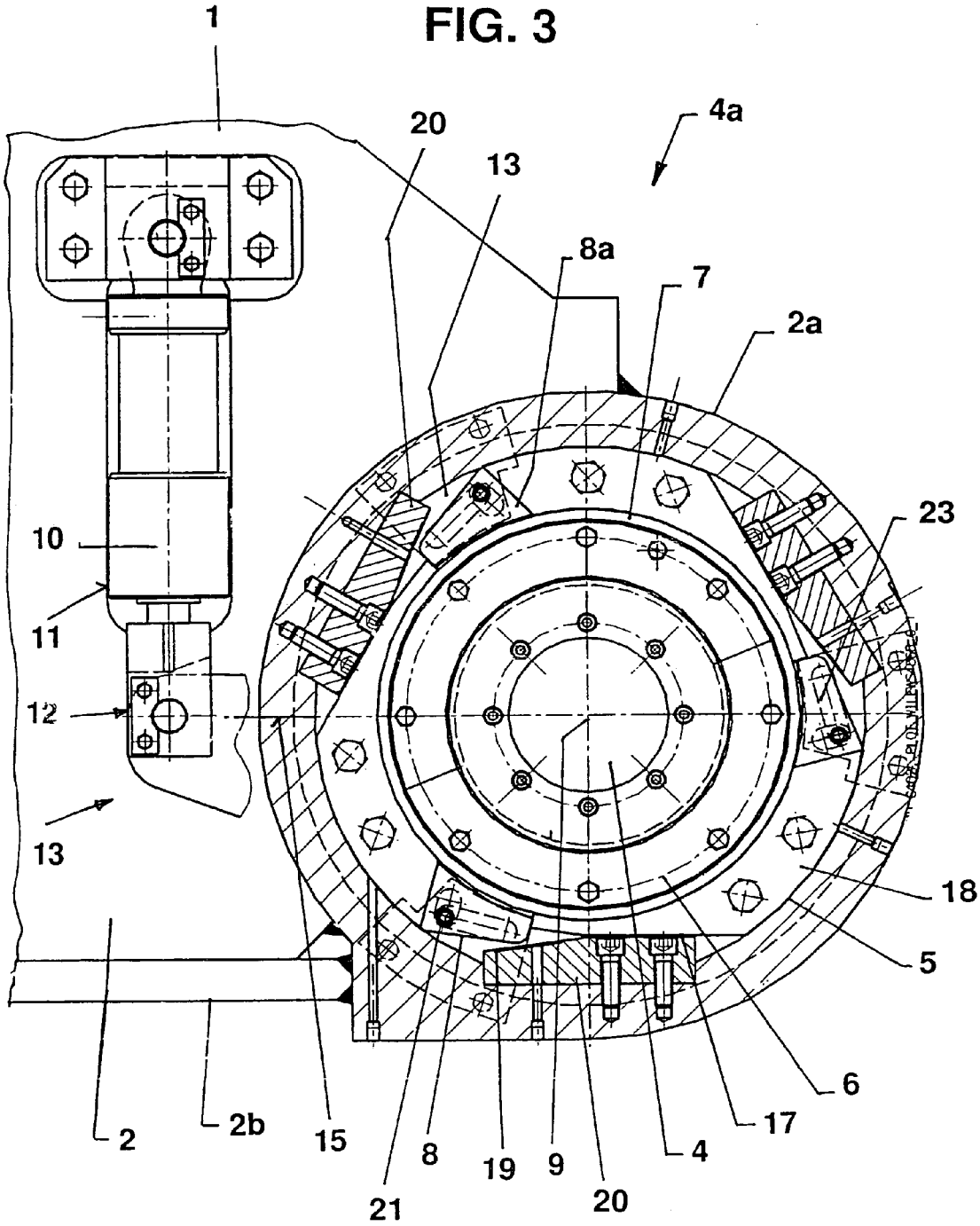
FIG. 3 shows a section of FIG. 1 in a view looking toward, the coiler mandrel bearing after the coiler mandrel bearing has been opened.
Figure 4:
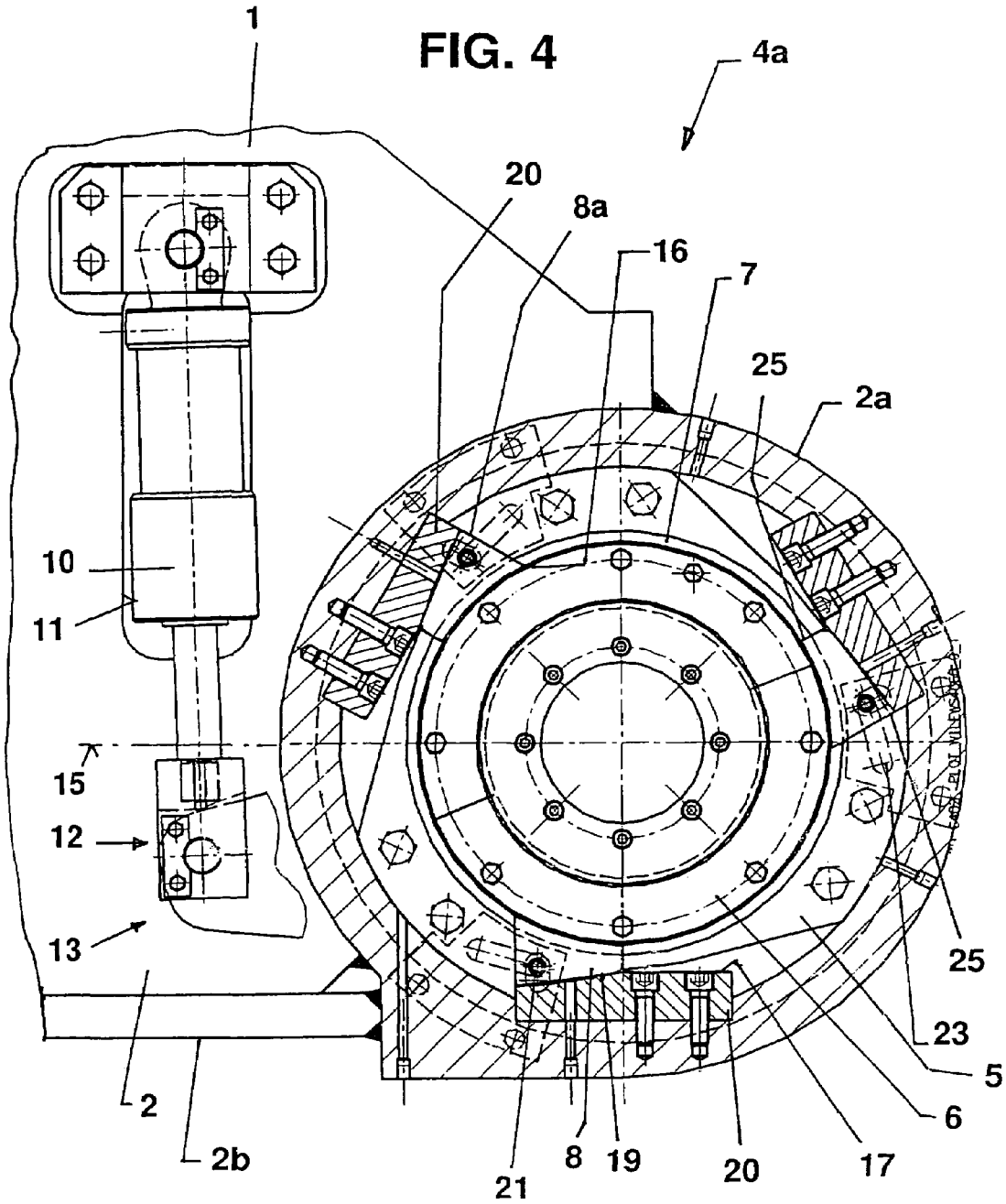
FIG. 4 shows the same section as FIG. 3 under the assumption that the coiler mandrel will sag about 10 mm, the coiler mandrel bearing being closed.

The clamping element 8 is formed by a clamping block 8*a*, which slides along the control surface 17 of the slide piece 20. A section 19 of the control surface 17 is formed by a slide piece 20, which is attached to the inner ring 5. The slide piece 20 which faces the center 9 is designed to conform to the curvature of the outer ring 6 swivel bearing, which encloses a conical roller bearing 6*a*. Each clamping block 8*a* is pivotably supported on an axis 21, which is mounted in brackets 22 on both sides, the axis passing through the clamping block 8*a* and ending on the outside at the rigidly mounted support ring 2*a* (FIG. 2). In addition, FIG. 3 shows' a wide slot 23, which allows the clamping block 8*a* to perform superimposed radial and tangential movements.

Figure 5:
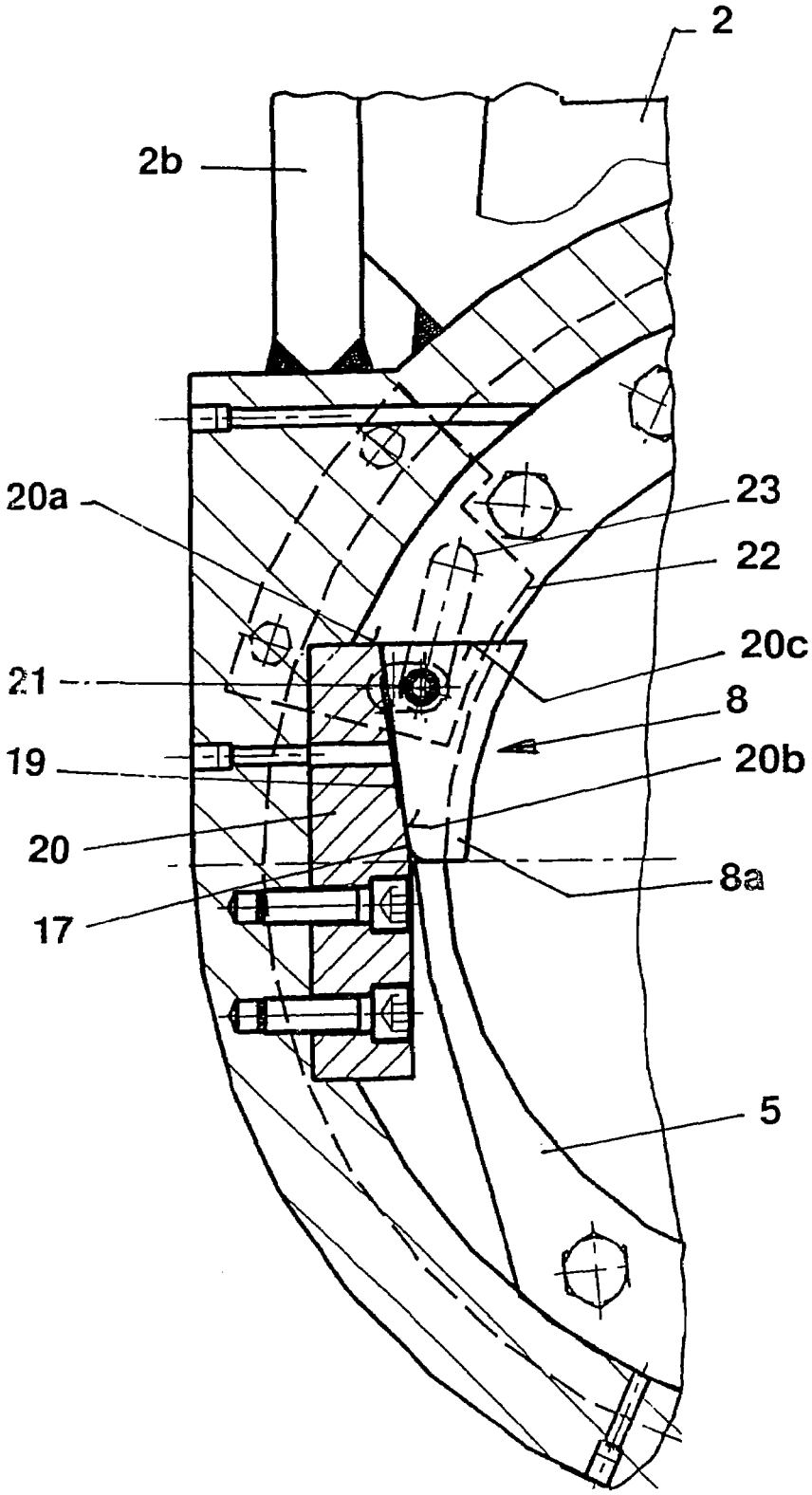
FIG. 5 shows an enlarged partial cross section through the clamping block with the slide piece.

The enlarged view in FIG. 5 shows that the stop face 20*a*, a sliding surface 20*b*, and a guide surface 20*c* are also functionally important. The mechanical stop face 20*a* between the inner ring 5 and the slide block 20 clearly establishes the end position of the clamping elements 8 and prevents the clamping elements 8 from jamming.

Figure 6:
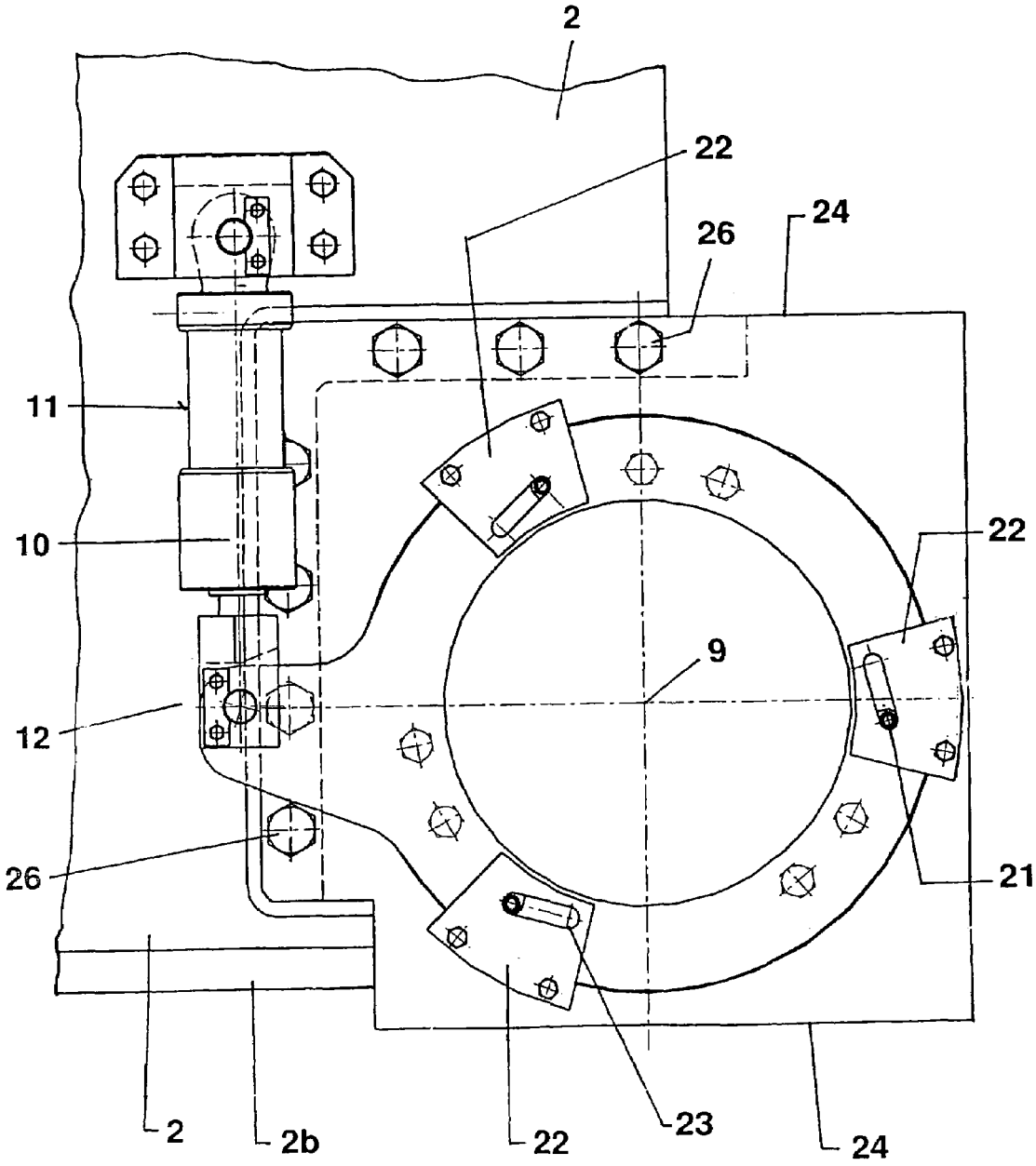
FIG. 6 shows a view of an interchangeable cartridge.

FIG. 6 shows an alternative embodiment of an otherwise similar design. The support ring 2*a* can be designed as a completely interchangeable cartridge 24, which is mounted in the support frame 2. Spare cartridges can thus be kept on hand, and fabrication is greatly simplified. The cartridge 24 can be easily removed by unscrewing the horizontal row of bolt connections 26 and the vertical row of bolt connections 26 and then replaced with a new cartridge 24.

LIST OF REFERENCE NUMBERS

1 swinging gate
2 support frame
2*a* support ring
2*b* rib
3*a* swivel bearing
3*b* swivel bearing
4 coiler mandrel
4*a* coiler mandrel bearing
5 inner ring
6 outer ring of swivel bearing
6*a* conical roller bearing
7 annular gap
8 clamping element
8*a* clamping block
9 theoretical center of the coiler mandrel
10 piston-cylinder drive unit
11 housing of the piston-cylinder drive unit
12 piston rod with forked end
13 open position
14 hinge point of piston rod
15 horizontal plane
16 closed position
17 control surface
18 surface-welded segment
19 section
20 slide block
20*a* stop face
20*b* sliding surface
20*c* guide surface
21 pivot axis
22 bracket
23 wide slot
24 cartridge
25 parallel guides
26 bolt connections

The invention claimed is:

1. Coiler for metal strip, especially steel strip, with a coiler mandrel (4) rotatably supported in coiler mandrel bearings (4*a*), wherein the coiler mandrel bearing (4*a*) is surrounded by an annular gap (7) extending around the outer ring (6) of a swivel bearing, and that the outer ring (6) of the swivel bearing can be centered by means of circumferentially spaced clamping elements (8) which can be closed radially inwardly after the coiler mandrel (4) has been inserted or can move freely inside the annular gap (7) after the clamping elements (8) have been moved back out.

2. Coiler in accordance with claim 1, wherein the annular gap (7) is designed to accommodate a deviation of at least 10 mm in the position of the coiler mandrel (4).

3. Coiler in accordance with claim 1, wherein a support ring (2*a*) formed on and attached to a bearing support (2) holds a rotatably supported inner ring (5), in which the clamping elements (8), which are operated by rotation, are installed.

4. Coiler in accordance with claim 3, wherein the inner ring (5) can be rotationally adjusted by means of a hinge-mounted piston-cylinder drive (10), which is installed outside the support ring (2*a*) with the hinge point of its lever action a certain distance away from the theoretical center (9) of the coiler mandrel.

5. Coiler in accordance with claim 4, wherein the piston-cylinder drive (10) can be shifted from the open position (13), in which the hinge point (14) of the piston rod (12) is in the same horizontal plane (15) as that of the theoretical center (9) of the coiler mandrel, to a closed position (16) below the horizontal plane (15) containing the theoretical center (9) of the coiler mandrel, where the housing (11) of the piston-cylinder drive (10) is attached to the bearing support (2) by a hinge-type joint.

6. Coiler in accordance with claim 5, wherein the clamping elements (8) are guided positively during both the closing and the opening operation.

7. Coiler in accordance with claim 3, wherein the inner ring (5) is provided with control surfaces (17) distributed around the circumference, each more-or-less tangential to the outer ring (6) of the swivel bearing for the coiler mandrel (4) to be centered, on which surfaces the clamping elements (8) make sliding contact.

8. Coiler in accordance with claim 6, wherein each clamping element (8) consists of a clamping block (8*a*), which can slide along the associated control surface (17).

9. Coiler in accordance with claim 8, wherein the clamping block (8*a*) which faces the center (9) is designed to conform to the curvature of the outer ring (6) of the swivel bearing.

10. Coiler in accordance with claim 8, wherein each clamping block (8*a*) is supported on a pivot axis (21), which is supported in brackets (22) on both sides, the axis passing through the clamping block (8*a*) and ending on the outside at the rigidly mounted support ring (2*a*).

11. Coiler in accordance with claim 6, wherein a section (19) of each of the control surfaces (17) consists of a sliding block (20), which is mounted on the inner ring (5).

12. Coiler in accordance with claim 10, wherein a mechanical stop face (20*a*) is formed between the inner ring (5) and a slide block (20).

13. Coiler in accordance with claim 3, wherein the support ring (2*a*) in the support frame (2) is designed as an interchangeable cassette (24).

* * * * *